US008285429B2

(12) United States Patent
Kumar

(10) Patent No.: US 8,285,429 B2
(45) Date of Patent: Oct. 9, 2012

(54) AUTOMATIC ESTIMATION OF TRAIN CHARACTERISTICS

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 583 days.

(21) Appl. No.: 12/430,820

(22) Filed: Apr. 27, 2009

(65) Prior Publication Data

US 2009/0271052 A1 Oct. 29, 2009

Related U.S. Application Data

(60) Provisional application No. 61/048,455, filed on Apr. 28, 2008.

(51) Int. Cl.
*G06F 17/00* (2006.01)

(52) U.S. Cl. ..... 701/19; 701/20; 702/175

(58) Field of Classification Search ..... 701/19, 701/20, 82, 93, 58, 70, 29, 61, 760; 246/182 R, 246/182 C, 185, 186, 187 C; 180/14.1; 318/802, 318/806; 340/501, 502; 702/173, 175; 177/25.13
See application file for complete search history.

(56) References Cited

U.S. PATENT DOCUMENTS 6,144,928 A * 11/2000 Leimbach et al. ..... 702/173
6,580,976 B1 * 6/2003 Belcea ..... 701/20
6,633,006 B1 * 10/2003 Wolf et al. ..... 177/25.13
6,829,943 B2 * 12/2004 Weyand et al. ..... 73/760
7,021,588 B2 4/2006 Hess, Jr. et al.
2006/0138285 A1 6/2006 Oleski et al.
2007/0137514 A1 6/2007 Kumar et al.
2007/0219680 A1 9/2007 Kumar et al.
2007/0219681 A1 9/2007 Kumar et al.
2007/0225878 A1 9/2007 Kumar et al.
2007/0233335 A1 10/2007 Kumar et al.
2007/0233364 A1 10/2007 Kumar
2008/0082223 A1 4/2008 Daum et al.
2008/0125924 A1 5/2008 Daum et al.
2008/0128562 A1 6/2008 Kumar et al.
2008/0154452 A1 6/2008 Kapp et al.
2008/0161984 A1 7/2008 Hrdlicka et al.
2008/0167766 A1 7/2008 Thiyagarajan et al.
2008/0167767 A1 7/2008 Brooks et al.
2008/0183345 A1 7/2008 Chandra et al.
2008/0183490 A1 7/2008 Martin et al.
2008/0195269 A1 8/2008 Lacy et al.
2008/0201019 A1 8/2008 Kumar et al.
2008/0201028 A1 8/2008 Brooks et al.
2008/0208401 A1 8/2008 Kumar et al.
2008/0249693 A1 * 10/2008 Kresse ..... 701/61
2008/0269967 A1 10/2008 Kumar et al.
2008/0312775 A1 12/2008 Kumar
2009/0090818 A1 4/2009 Kumar
2009/0192664 A1 * 7/2009 Wolfgang et al. ..... 701/29
2010/0262321 A1 * 10/2010 Daum et al. ..... 701/20

* cited by examiner

*Primary Examiner* — Mark Le
(74) *Attorney, Agent, or Firm* — GE Global Patent Operation; John A. Kramer

(57) ABSTRACT

A system is provided for controlling a series of vehicles. In certain embodiments, the system includes a self-analysis/estimation system configured to control a first parameter of the series of vehicles to impart a resulting changing in a second parameter of the series of vehicles. The self-analysis/estimation system is configured to estimate a third parameter based on the first and second parameters, wherein the third parameter comprises weight, weight distribution, tractive effort, grade, or a combination thereof, associated with the series of vehicles.

7 Claims, 10 Drawing Sheets

AUTOMATIC ESTIMATION OF TRAIN CHARACTERISTICS

CROSS REFERENCE TO RELATED APPLICATIONS

This application claims priority of U.S. Provisional Patent Application No. 61/048,455, entitled "Automatic Estimation of Train Characteristics," filed Apr. 28, 2008, which is herein incorporated in its entirety by reference.

BACKGROUND

The present invention relates generally to the operation of a series of interconnected vehicles, such as a train or other rail-based vehicle system. More specifically, the invention relates to the automatic estimation of characteristics of a series of interconnected vehicles.

Various transportation systems use a series of interconnected vehicles. These systems may include, but are not limited to, trains, subways, other rail-based vehicles systems, semi-trailers, off-highway vehicles, certain marine vessels, and so forth. These transportation systems may be very complex with numerous subsystems. For instance, an average train may be 1-2 miles long, include 50-150 or more rail cars, and be driven by 2-3 locomotive consists which, combined, include 6 or more locomotive units. The operation of the train depends on a variety of parameters, such as total weight, distribution of the weight among rail cars, emissions requirements, grade and curvature of the route, fuel consumption, power characteristics of the locomotive units, and so forth. Unfortunately, many of these parameters are unknown and/or based on rough estimates. For example, a dispatch office generally provides an estimation of the weight of the rail cars. Unfortunately, the handling, fuel consumption, emissions, and other parameters are adversely affected by incorrect estimates of weight.

BRIEF DESCRIPTION

A system is provided for controlling a series of vehicles. In certain embodiments, the system includes a self-analysis/estimation system configured to control a first parameter of the series of vehicles to impart a resulting changing in a second parameter of the series of vehicles. The self-analysis/estimation system is configured to estimate a third parameter based on the first and second parameters, wherein the third parameter comprises weight, weight distribution, tractive effort, grade, or a combination thereof, associated with the series of vehicles.

DRAWINGS

These and other features, aspects, and advantages of the present invention will become better understood when the following detailed description is read with reference to the accompanying drawings in which like characters represent like parts throughout the drawings, wherein.

Figure 7:
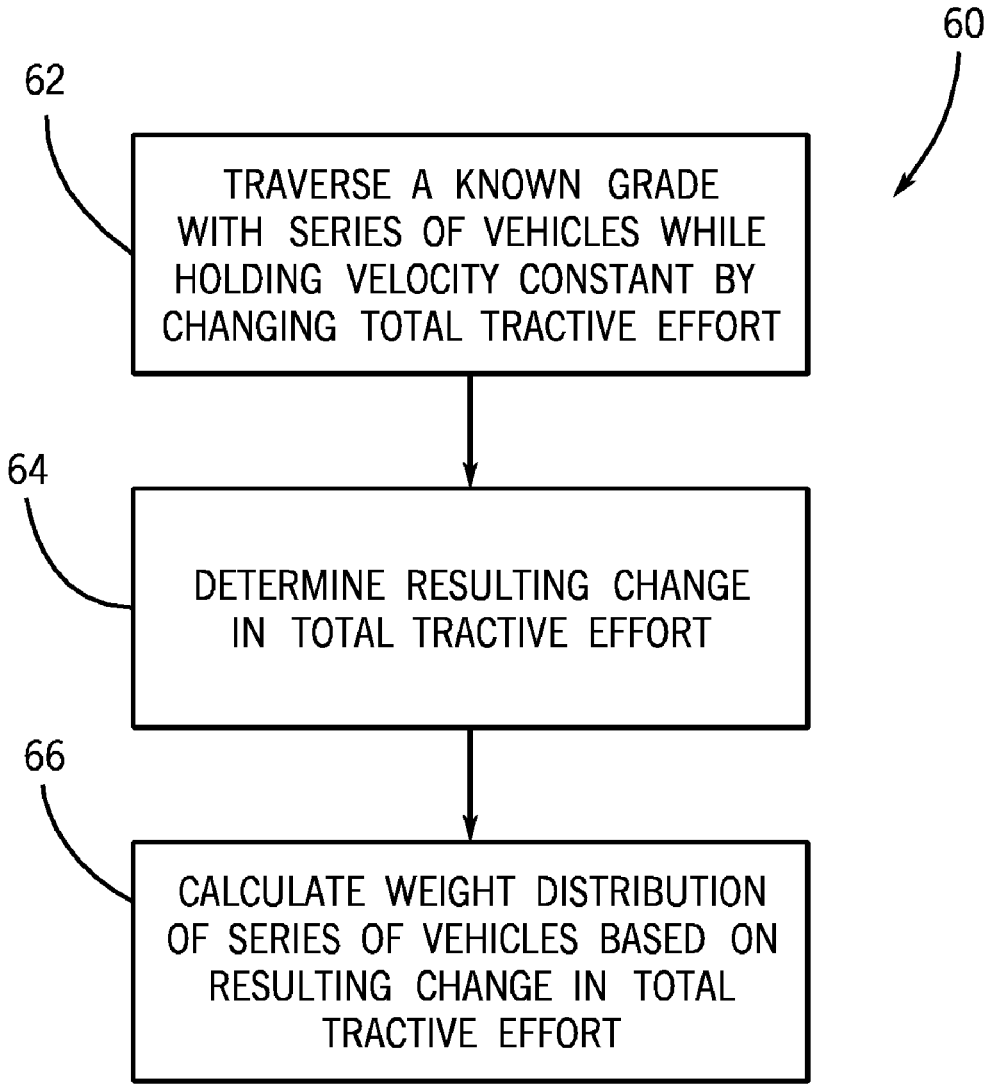
Figure 8A:
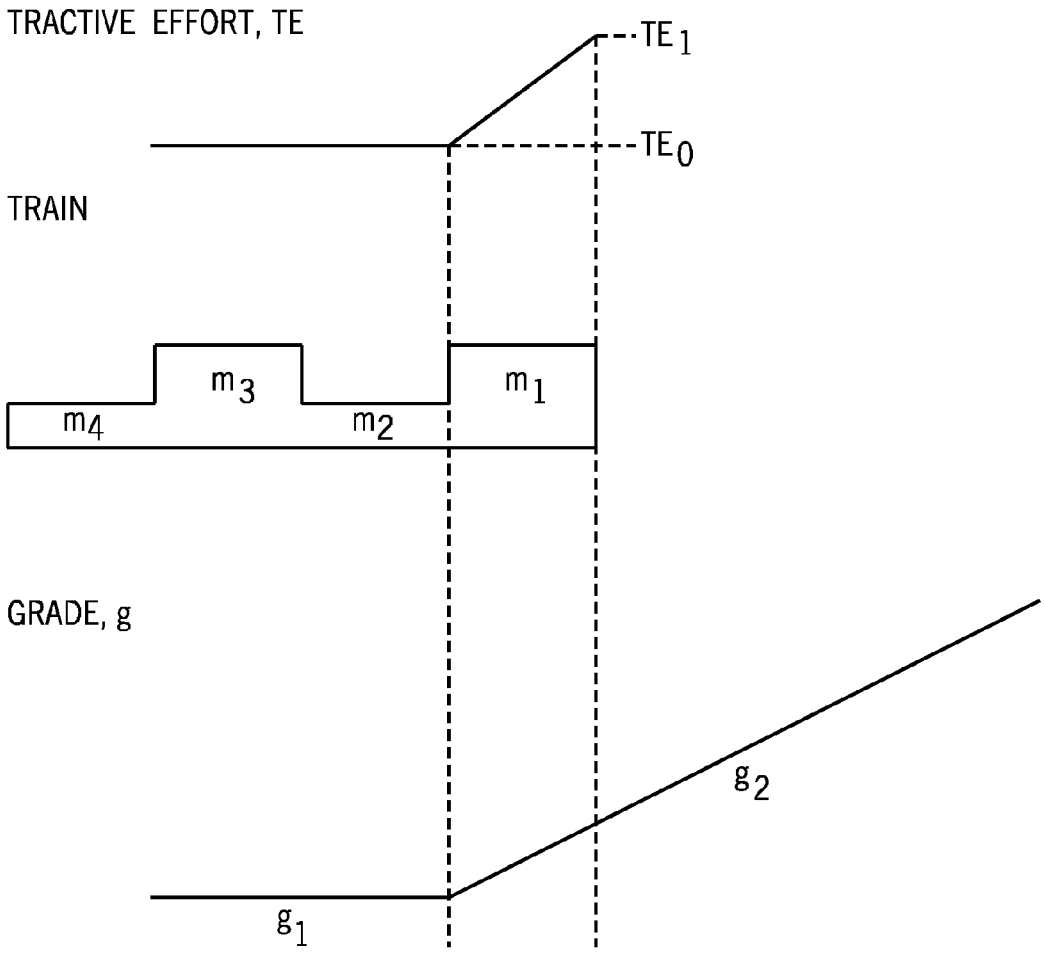
Figure 8B:
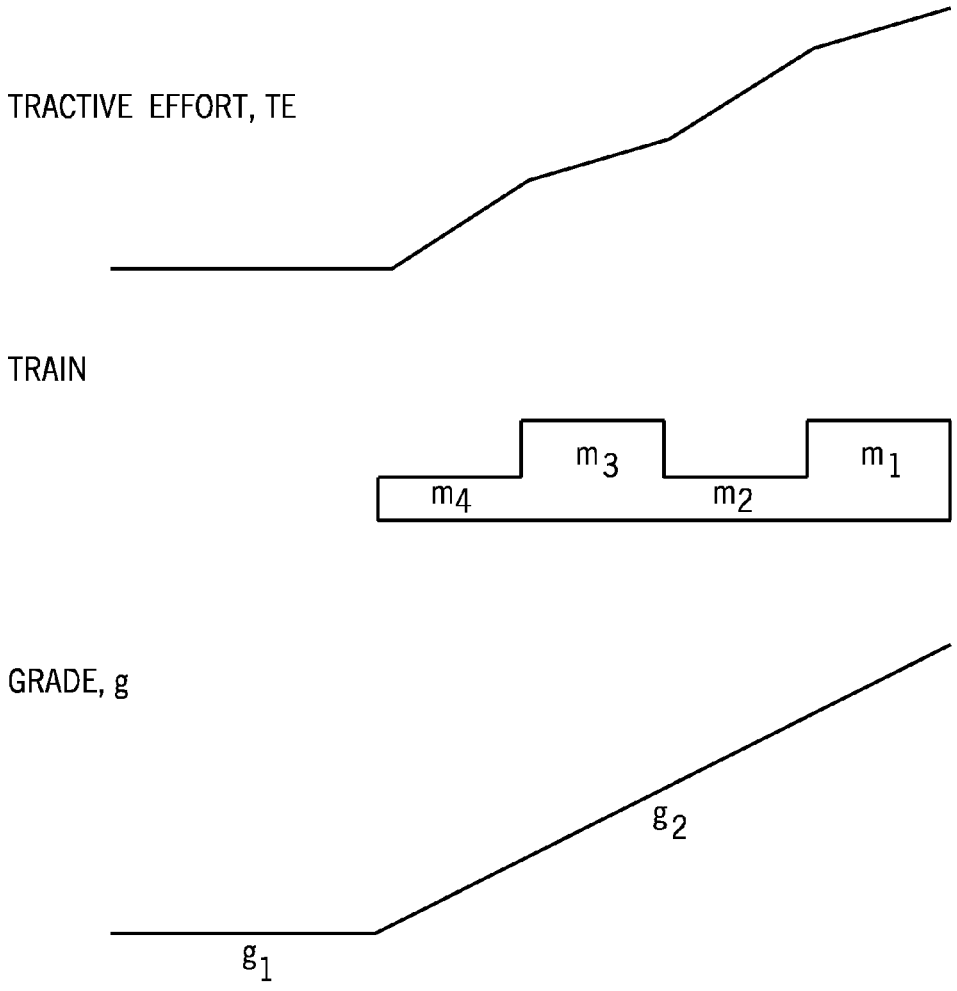
Figure 8C:
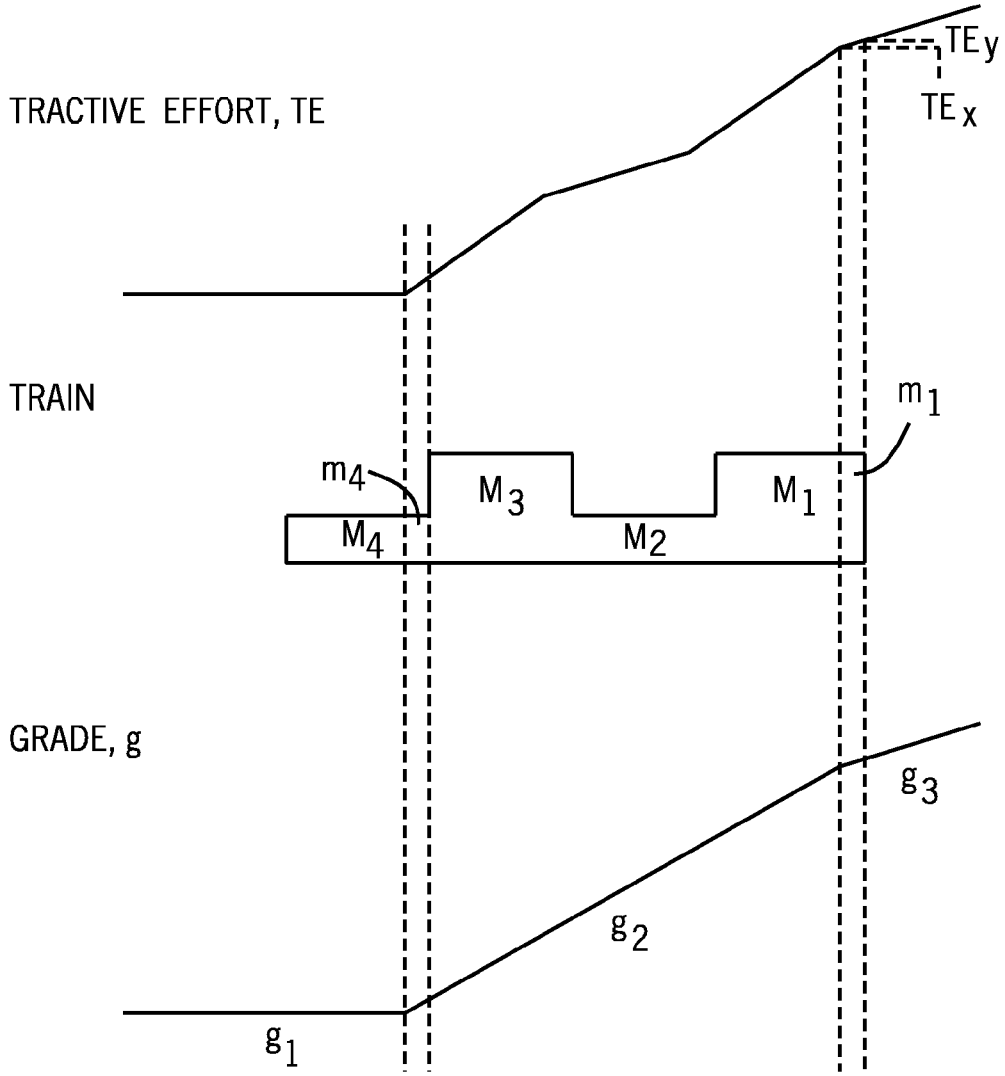

FIG. 7 is a flow chart of an embodiment of a process (e.g., a computer-implemented method) of estimating the weight distribution of a series of vehicles based on a resulting change in tractive effort over a known grade while holding the velocity constant; and FIGS. 8A through 8C are graphical representations of changes in tractive effort over a known grade while velocity is held constant in accordance with certain embodiments of the present technique.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters are not exclusive of other parameters of the disclosed embodiments.

As discussed in detail below, a variety of transportation systems (e.g., a locomotive system having a series of rail cars) may employ an advanced control system with a trip optimization system configured to optimize various parameters during a particular trip. In the disclosed embodiments, the trip optimization system includes one or more self-analysis/estimation systems configured to estimate parameters in real-time on-board the transportation system, thereby enabling improved operation, responsiveness, and overall optimization of the particular trip. In general, embodiments of the self-analysis/estimation system estimate one or more parameters by evaluating responsiveness to changes in the transportation system. For example, as discussed below, the self-analysis/estimation system can estimate total weight, weight distribution, traction force, and other parameters in response to a change in traction force, grade, and so forth. Upon estimating these parameters, the advanced control system can optimize handling of the transportation system through different grades and curvatures of the trip. In particular, the estimates of weight and weight distribution are helpful in optimizing speed and handling through complex routes, such as those including many changes in grade (e.g., inclines and declines) and curvature. The advanced control system can also optimize specific fuel consumption (SFC), exhaust emissions (e.g., nitrogen oxides, sulfur oxides, carbon monoxide, particulate matter, etc.), time to destination, and so forth. Although the disclosed embodiments are discussed in context of a locomotive system, these embodiments are equally applicable to other transportation systems.

Figure 1:
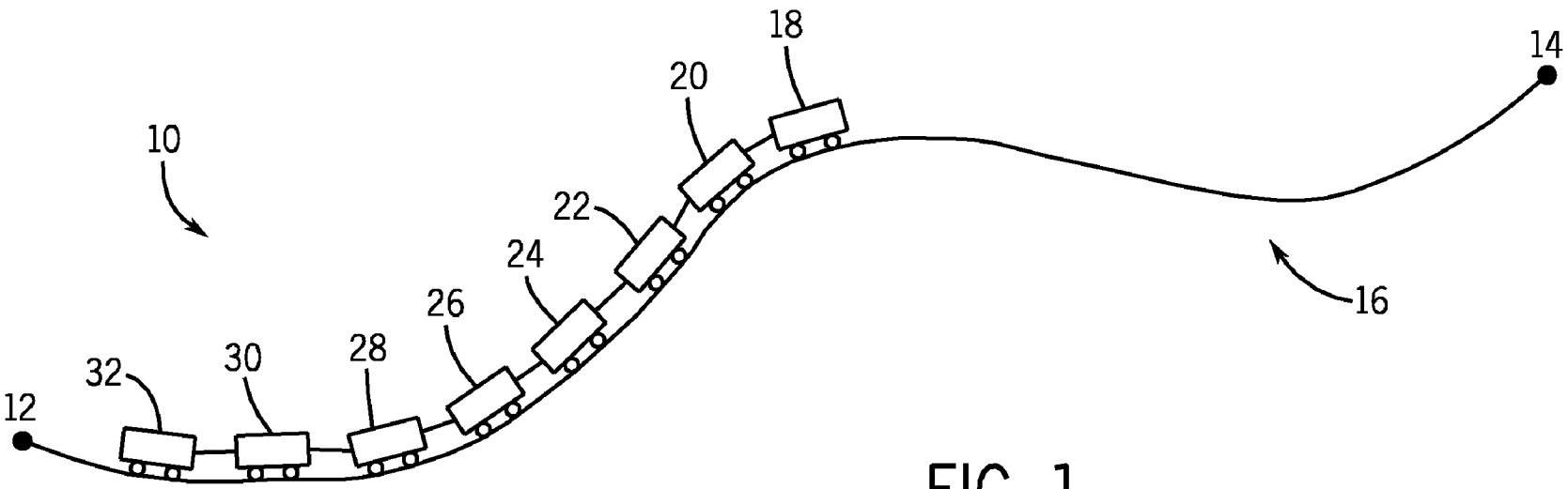
FIG. 1 is a diagram of an embodiment of a transportation system having a series of vehicles traveling from a departure point to a destination point, wherein the transportation system includes a trip optimization system having a self-analysis/estimation system.

FIG. 1 is a diagram of an embodiment of a transportation system 10, such as a locomotive or train, having a trip optimization system with a self-analysis/estimation system. In the illustrated embodiment, the trip optimization system is configured to optimize various parameters of a trip of the train 10, including a series of vehicles, from a departure point 12 to a destination point 14 along a route 16. The train 10 may include several locomotive units and, perhaps, hundreds of rail cars. However, as depicted, the train 10 includes eight individual cars 18, 20, 22, 24, 26, 28, 30, and 32 for simplicity. The train 10 may, for instance, include a lead locomotive 18, a trail locomotive 20, a remote locomotive 32, and five intermediate rail cars 22, 24, 26, 28, and 30.

For purposes of this disclosure, a "lead locomotive" is a locomotive which the operator directly controls and for which the tractive effort characteristics are known. Conversely, a "trail locomotive" is a locomotive which receives directions indirectly from the operator via the lead locomotive and for which the tractive effort characteristics are not known. Each grouping of locomotives may be referred to as a "locomotive consist." There may be multiple locomotive consists in a train 10. For instance, in the example discussed above, locomotives 18 and 20 would form a first consist while locomotive 32 would form a second consist. In addition, "tractive effort" may be defined as the pulling force generated by a locomotive unit.

As the train 10 travels from the departure point 12 to the destination point 14, the grade and curvature of the route 16 may vary significantly. In addition, the route 16 may contain certain areas through which the speed of the train 10 must be regulated. For instance, the route 16 may cross roadways, populated areas, or other zones where the speed of the train 10 may need to be reduced. These variations in the route 16, coupled with the varied weight distribution of the train 10, may make operation of the train 10 more complicated. For instance, if the train 10 was conversely traveling across a route 16 with no grade or curvature changes, through which no reduction in speed was required, and weight was evenly distributed throughout the length of the train 10, operation would be much easier. In this simpler scenario, the train 10 could simply be accelerated from the departure point 12 to a maximum speed and then decelerated upon approach to the destination point 14. However, since these variations invariably exist, more thought is required in how to best accelerate and decelerate the train 10 and, more specifically, when and how to apply tractive effort via the locomotive units.

These decisions may be made in order to optimize several operating parameters for a trip from the departure point 12 to the destination point 14. For example, fuel consumption may be minimized for the trip. In addition, other factors may be optimized such as exhaust emissions, time to destination, maximum forces created, handling of the rail cars across inclines/declines and severe curves, noise and vibration, and so forth. The trip optimization may be accomplished by utilizing a computer-implemented system (e.g. computer software code) for processing various input variables and optimizing particular trip parameters which are determined to be most important. For instance, for a given trip, it may determined that the most important trip parameters are time to destination and emissions. Therefore, the computer-implemented system may determine an optimum plan for maneuvering the train 10 from the departure point 12 to the destination point 14 as quickly as possible while minimizing the emissions output. The generated trip plan may include, for instance, an optimum speed per mile marker along the route 16. Alternatively, the generated trip plan may include an optimum notch setting per mile marker along the route 16, the notch setting corresponding to a throttle position (e.g. notch 1-8) for the locomotive units.

The inputs used to generate the trip plan may include, but are not limited to, the total weight and weight distribution of the train 10, the locomotive units' power and transmission characteristics, the grade and curvature profile of the route 16, the train's 10 current location along the route 16, fuel consumption as a function of power output of the locomotive units, drag coefficients, start time, desired travel time, weather and traffic conditions, and so forth. This information may be either manually entered or automatically input via remote sources (e.g., a dispatch office) or other memory devices (e.g., hard drives, flash cards, and so forth).

Unfortunately, without the presently disclosed self-analysis/estimation system, this information often proves problematic for various reasons. For instance, the information may have been entered incorrectly, either by the operator or another person. In addition, the information may often represent rough estimations or guesstimates not based on actual data. For instance, power ratings for locomotive units are often merely rated values and not representative of actual tractive effort which may be generated by the locomotive units. Furthermore, the information may not always be up to date. One reason for this is that the information may be time consuming and expensive to generate and update on a regular basis. It may also be expensive to store and transmit the information, requiring not only information systems to retain the information but communication systems to relay the information.

Embodiments of the present invention may address some of these problems by allowing some of the information discussed above to be automatically estimated at the beginning of a trip without the need for the information to be either manually entered or otherwise input from remote sources or memory devices. In particular, embodiments of the present invention allow for the automatic estimation of total weight of the series of vehicles, weight distribution among the series of vehicles, and unknown values of tractive effort available from locomotive units. The automatic estimation of these parameters may prove useful in that the information may otherwise be undependable, inexact, or, as mentioned above, time consuming and expensive to compile and manage.

For example, the weight of all the locomotives and rail cars of a train 10 are not always known. Therefore, the total weight and weight distribution of the train 10 are similarly uncertain. The weight of the locomotives will often be known and supplied by the manufacturer of the unit. Rather, the uncertainty with respect to total weight of a train 10 is usually primarily due to the rail cars. Rail cars transported by trains 10 sometimes come with manifests which attempt to estimate the weight of the rail cars. Unfortunately, this information can be undependable as it is often merely a guess or rough estimate. Automatically estimating the total weight of the train 10 may eliminate this dependence on rough estimations, while also obviating the need for even attempting to keep track of this information in some instances. As such, not only may the accuracy of trip optimization be improved but the overall cost of rail car management may be reduced.

In addition, the tractive effort available from locomotive units is not always known. The lead locomotive may operate with a known tractive effort because the operator is directly controlling the unit and values such as voltage, current, and so forth, which are readily measurable and controllable by the operator. However, trail locomotives may be indirectly controlled and may not be configured to communicate this information. Locomotives have power ratings which indicate how much power and, therefore, how much tractive effort the unit is capable of producing. However, these are merely rated values and do not take into account specific operating conditions of the locomotive unit. Therefore, the ability to automatically estimate the tractive effort available from trail locomotive units may again lead to greater accuracy of trip optimization and, in general, lead to a more complete picture of the operating capability for a given train 10.

Figure 2:
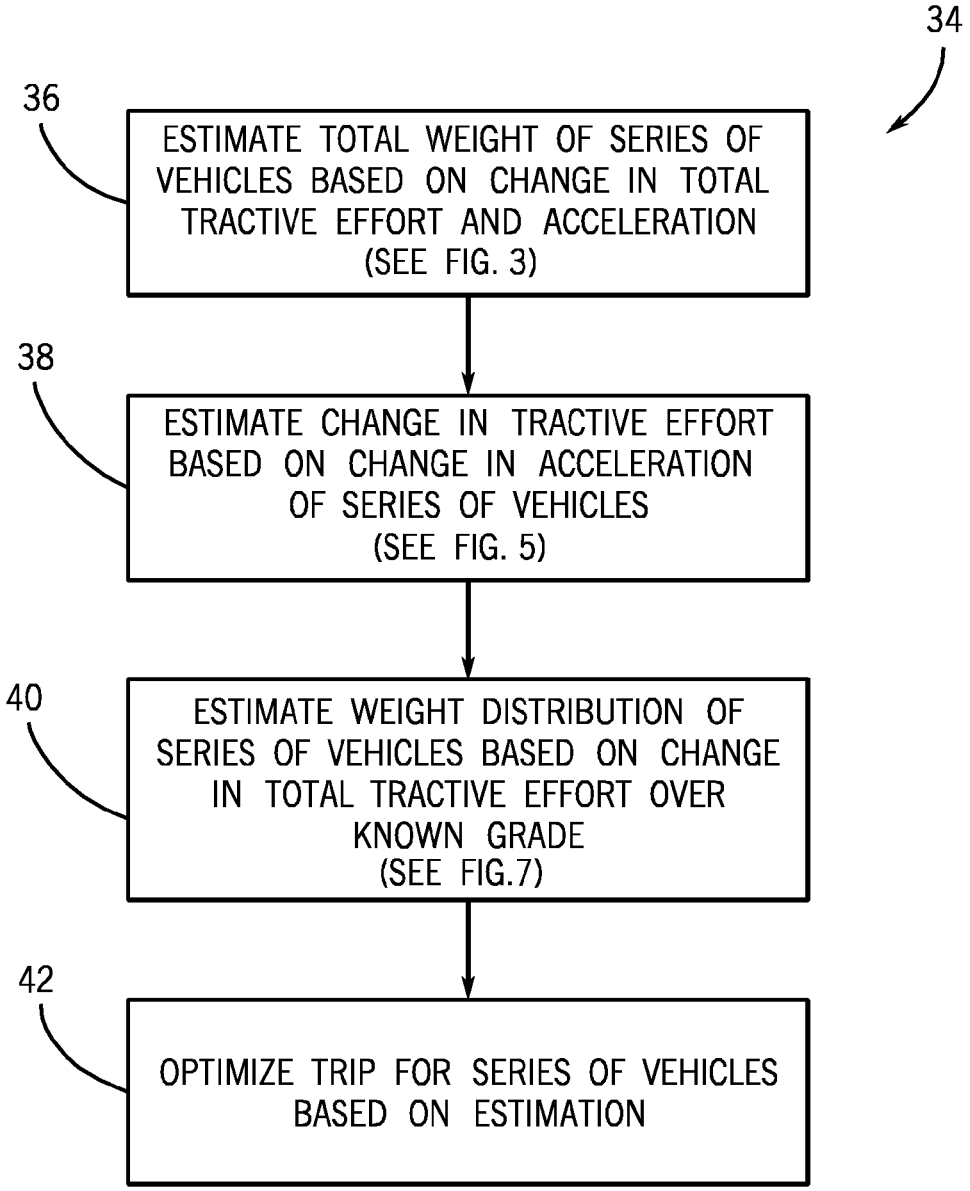
FIG. 2 is a flow chart of an embodiment of a process (e.g., a computer-implemented method) of automatically estimating parameters of a series of vehicles and optimizing a trip based on the estimations.

Therefore, embodiments of the present invention allow for the automatic estimation of total weight and weight distribution of a series of vehicles, such as the train 10, and automatic estimation of the unknown tractive effort available from locomotive units configured to drive the series of vehicles. FIG. 2 is a flow chart of an embodiment of a process 34 (e.g., a computer-implemented method) for automatically estimating these parameters and optimizing a trip based on the estimations. The total weight of a series of vehicles may be estimated based on a change in total tractive effort and the resulting change in acceleration of the series of vehicles (step 36), as described in further detail below with respect to FIG. 3. In addition, a value for a change in unknown tractive effort (e.g., of a trail locomotive) may be estimated based on the change in the unknown tractive effort and the resulting change in acceleration of the series of vehicles, assuming that the total weight of the series of vehicles is known (step 38), as described in further detail below with respect to FIG. 5. For example, the total weight of the series of vehicles may have previously been determined using the techniques of step 36 of the process 34. Also, the weight distribution of the series of vehicles may be estimated based on a change in tractive effort over a known grade while holding the velocity of the series of vehicles constant (step 40), as described in further detail below with respect to FIG. 7. Finally, one or more of the parameters estimated in steps 36, 38, and 40 may be used to optimize a trip for the series of vehicles (step 42).

The steps for estimating parameters of the series of vehicles (e.g. steps 36, 38, and 40) are optional to the process 34 and may be utilized either independently or in any combination. An example is that the steps 36 and 38 for estimating the total weight of the series of vehicles and unknown tractive efforts may be utilized together. For instance, the step 36 of estimating the total weight of the series of vehicles may first be performed by changing the total tractive effort of the series of vehicles by a known amount (e.g., using a lead locomotive) and observing the resulting change in acceleration of the series of vehicles. Then, after the total weight of the series of vehicles is known, the step 38 of estimating a value for a change in an unknown tractive effort (e.g., of a trail locomotive) may be performed by changing the tractive effort and again observing the resulting change in acceleration. However, this time, since the total weight of the series of vehicles is known, the amount of the tractive effort change may be estimated. Another example is that the step 40 of estimating the weight distribution of the series of vehicles may, as described in further detail below, be performed independently. Furthermore, even the step 42 of optimizing a trip based on the estimated parameters may be optional. For instance, the estimated parameters may simply be used for assistance during operation of the series of vehicles, rather than being a part of an attempt to optimize trip parameters for the series of vehicles.

Regardless of which estimation step is performed, an underlying mathematical premise applies. Specifically, a function common to all three methods of estimation may best be represented as:

$$\dot{v} = \frac{TE}{m} - (a + bv + cv^2) - g$$

where $\dot{v}$ is the acceleration of the series of vehicles, TE is the total tractive effort generated by the locomotive units of the series of vehicles, m is the total mass of the series of vehicles, v is the velocity of the series of vehicles, a, b, and c are called the Davis coefficients, and g depends on the track geometry, such as a grade. The variables TE, a, b, c, v, $\dot{v}$, and g change over time whereas the variable m is generally constant. In general, the term $(a+bv+cv^2)$ relates to both the rolling resistance and wind resistance exerted on the series of vehicles. The Davis coefficients (a, b, and c) are generally not known and vary depending on various factors such as wind velocity, rail friction, and so forth.

Figure 3:
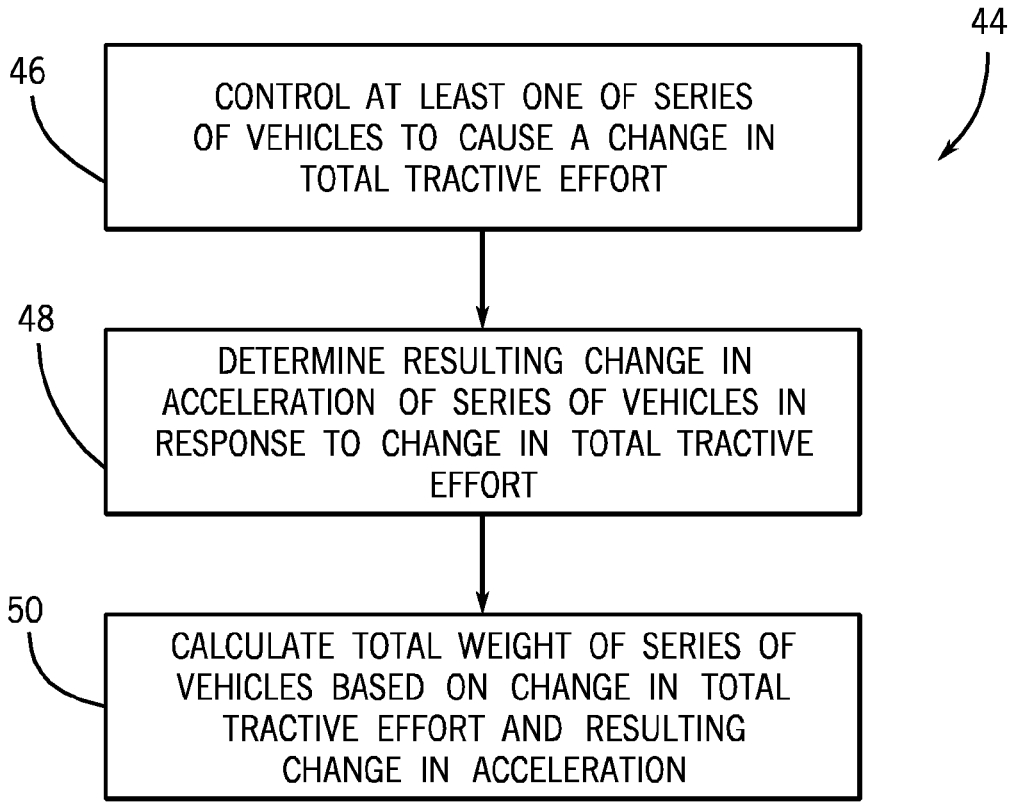
FIG. 3 is a flow chart of an embodiment of a process (e.g., a computer-implemented method) of estimating the total weight of a series of vehicles based on a change in total tractive effort and a resulting change in acceleration of the series of vehicles.

FIG. 3 illustrates an exemplary process 44 for automatically estimating the total weight of a series of vehicles. First, at least one of the vehicles may be controlled in such a manner as to cause a change in the total tractive effort generated by the series of vehicles (step 46). For example, the tractive effort of the lead locomotive of a train 10 may be increased. Next, the resulting change in acceleration of the series of vehicles in response to the change in total tractive effort may be determined (step 48). Then, the total weight of the series of vehicles may be calculated based on the change in total tractive effort and the resulting change in acceleration of the series of vehicles (step 50). The process 44 of estimating the total weight of the series of vehicles will be described herein in the context of a train 10. However, the disclosed embodiments may be applicable to any other application where a series of interconnected vehicles are used.

The process 44 of estimating the total weight of the train 10 may begin by determining whether the rail cars and locomotives of the train 10 are completely, or significantly, stretched or bunched together or at a steady state. This will allow a determination of whether an estimation of the total weight of the train 10 using the disclosed embodiments will lead to accurate results and, more specifically, whether the estimation will be untainted by the uncertainty of variations of the couplings between the rail cars and locomotives.

Figure 4:
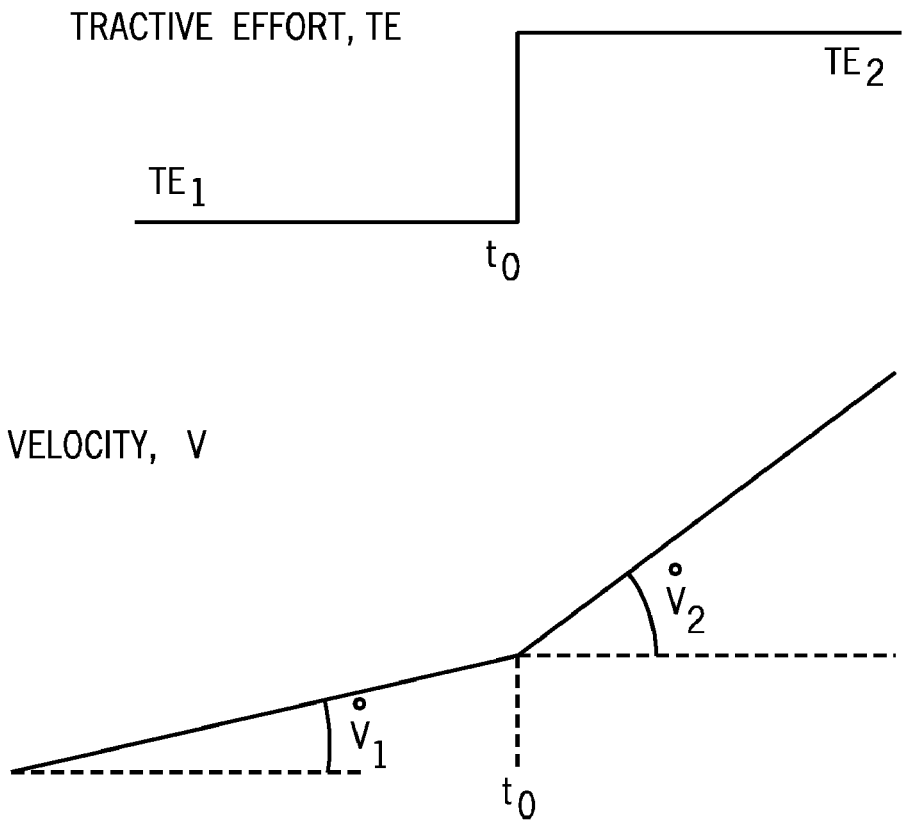
FIG. 4 is a graphical representation of changes in velocity and acceleration of a series of vehicles caused by changes in total tractive effort of locomotive units of the series of vehicles in accordance with certain embodiments of the present technique.

Once it is determined that the train 10 is in an appropriate state, the process 44 may be started at a time $t_0$ at which point the total tractive effort of the train 10 is changed from $TE_1$ to $TE_2$, as illustrated in FIG. 4. This may be done by holding constant the power of the locomotive units which are not communicating their tractive effort values to the lead locomotive and by changing the tractive effort on the locomotive units which are communicating their tractive effort values to the lead locomotive. For example, assume that three locomotive units are being used (e.g., one lead locomotive and two trail locomotives not communicating tractive effort information) and all are currently operating at notch 4 producing 26,000 pounds, 28,000 pounds, and 20,000 pounds of tractive effort, respectively. This leads to a value of total tractive effort before $t_0$ of $TE_1$=74,000 pounds. In this scenario, the tractive effort values for the two trail locomotives may be an estimated value, for instance, based on a rated value. By changing the notch of the lead locomotive from 4 to 7 at to and keeping the trail locomotives at notch 4, the generated tractive effort values may change to 54,000 pounds for the lead locomotive and remain at 28,000 and 20,000 for the two trail locomotives. This would lead to a total tractive effort after $t_0$ of $TE_2$=102,000 pounds. Therefore, the appropriate equations before and after $t_0$ will be:

$$\dot{v}_1 = \frac{TE_1 = 74{,}000}{m} - (a + bv_1 + cv_1^2) - g_1 \text{ before } t_0$$

and $$\dot{v}_2 = \frac{TE_2 = 102{,}000}{m} - (a + bv_2 + cv_2^2) - g_2 \text{ after } t_0.$$

The transition from tractive effort $TE_1$ to tractive effort $TE_2$ may take 10 seconds or so. However, within the context of accelerating the train 10 at the beginning of a trip, a 10-second time period may be considered somewhat instantaneous. As such, it may be assumed that the velocity v and grade g remain generally constant before and after $t_0$. For instance, the velocity v may only change from 28.0 miles per hour to 28.1 miles per hour. However, the acceleration $\bar{v}_1$ will certainly change by a substantial amount before and after $t_0$. This resulting change in acceleration may be determined using any suitable mechanism. For instance, it may be possible to use an accelerometer to measure the change in acceleration. However, it may be more practical to calculate the change in acceleration based on minute changes in velocity v over a very short period of time as the velocity v may be determined from speed information available on board the lead locomotive. Regardless, since velocity v and grade g remain generally constant before and after $t_0$, the resulting change in acceleration ($\dot{v}_2-\dot{v}_1$) would be primarily due to the change in total tractive effort ($TE_2$-$TE_1$). Therefore, the total mass of the locomotives and rail cars of the train 10 may be calculated using the equation:

$$m = \frac{TE_2 - TE_1}{\dot{v}_2 - \dot{v}_1} = \frac{102{,}000 - 74{,}000}{\dot{v}_2 - \dot{v}_1}$$

From this equation, the total mass, and therefore total weight, of the rail cars and the locomotives may be determined. This estimation may be performed at the beginning of a trip of the train 10. The tractive effort may be intentionally changed in order to make the determination. In other words, the estimation may be scheduled as a part of the initial acceleration of the train 10 and the estimated weight of the train 10 may thereafter be used as part of the trip optimization of the train 10. Furthermore, this estimation may be performed as part of either manual or automatic operation of the train 10.

Figure 5:
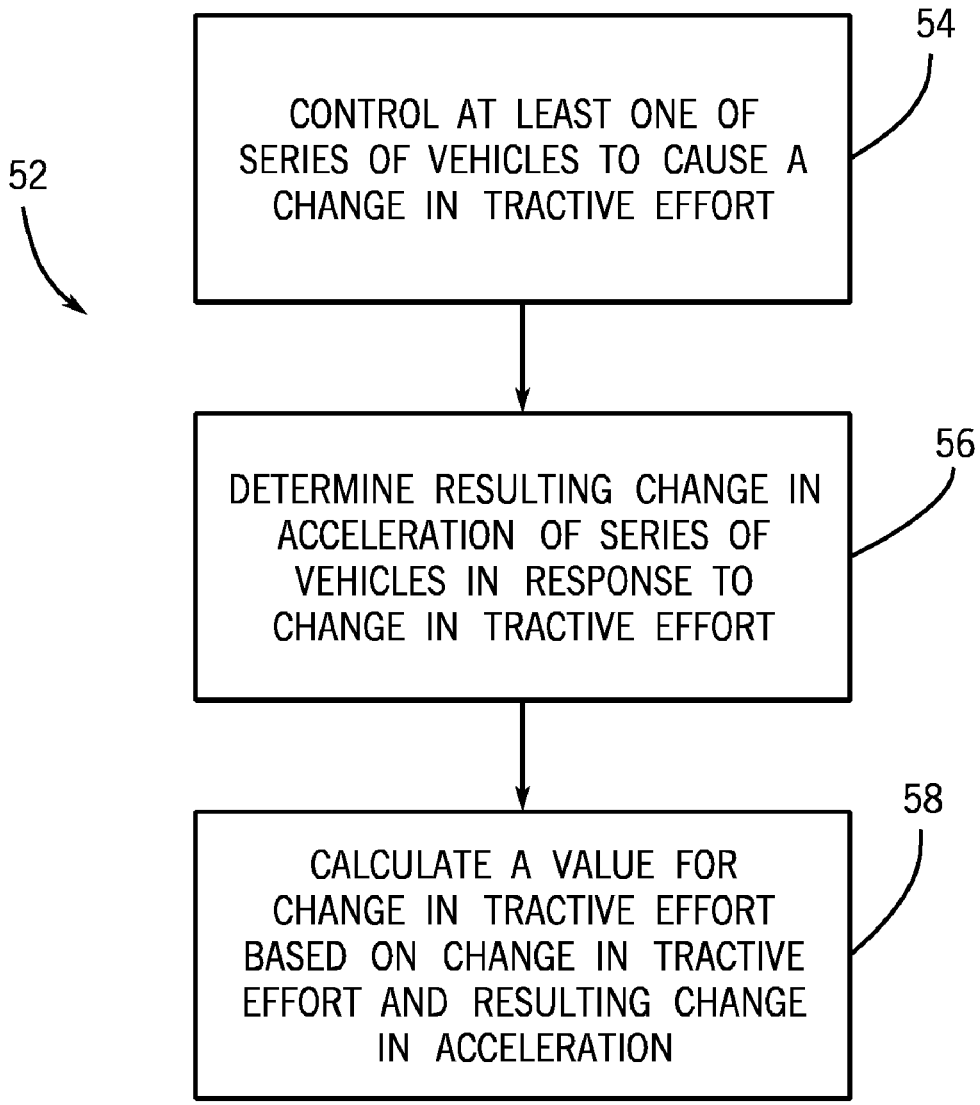
FIG. 5 is a flow chart of an embodiment of a process (e.g., a computer-implemented method) of estimating a change in tractive effort based on a resulting change in acceleration of a series of vehicles with a known weight.

FIG. 5 illustrates an exemplary process 52 for automatically estimating a value of a change in an unknown tractive effort value for a locomotive unit of a series of vehicles. First, at least one of the vehicles may be controlled in such a manner as to cause a change in a tractive effort generated by the series of vehicles (step 54). For example, in this instance, the tractive effort of a trail locomotive of a train 10 may be decreased. Next, the resulting change in acceleration of the series of vehicles in response to the change in tractive effort may be determined (step 56). Then, a value for the change in tractive effort may be calculated based on the change in tractive effort and the resulting change in acceleration of the series of vehicles (step 58). In a similar manner, as described above with respect to the process 44 of estimating the total weight of the series of vehicles, the process 52 of estimating the change in tractive effort will be described herein in the context of a train 10. Once again, the disclosed embodiments may be applicable to any other application where a series of interconnected vehicles are used. Also, the process 52 of estimating the change in tractive effort may again begin by determining whether the rail cars and locomotives of the train 10 are completely, or significantly, stretched or bunched together or at a steady state.

Figure 6:
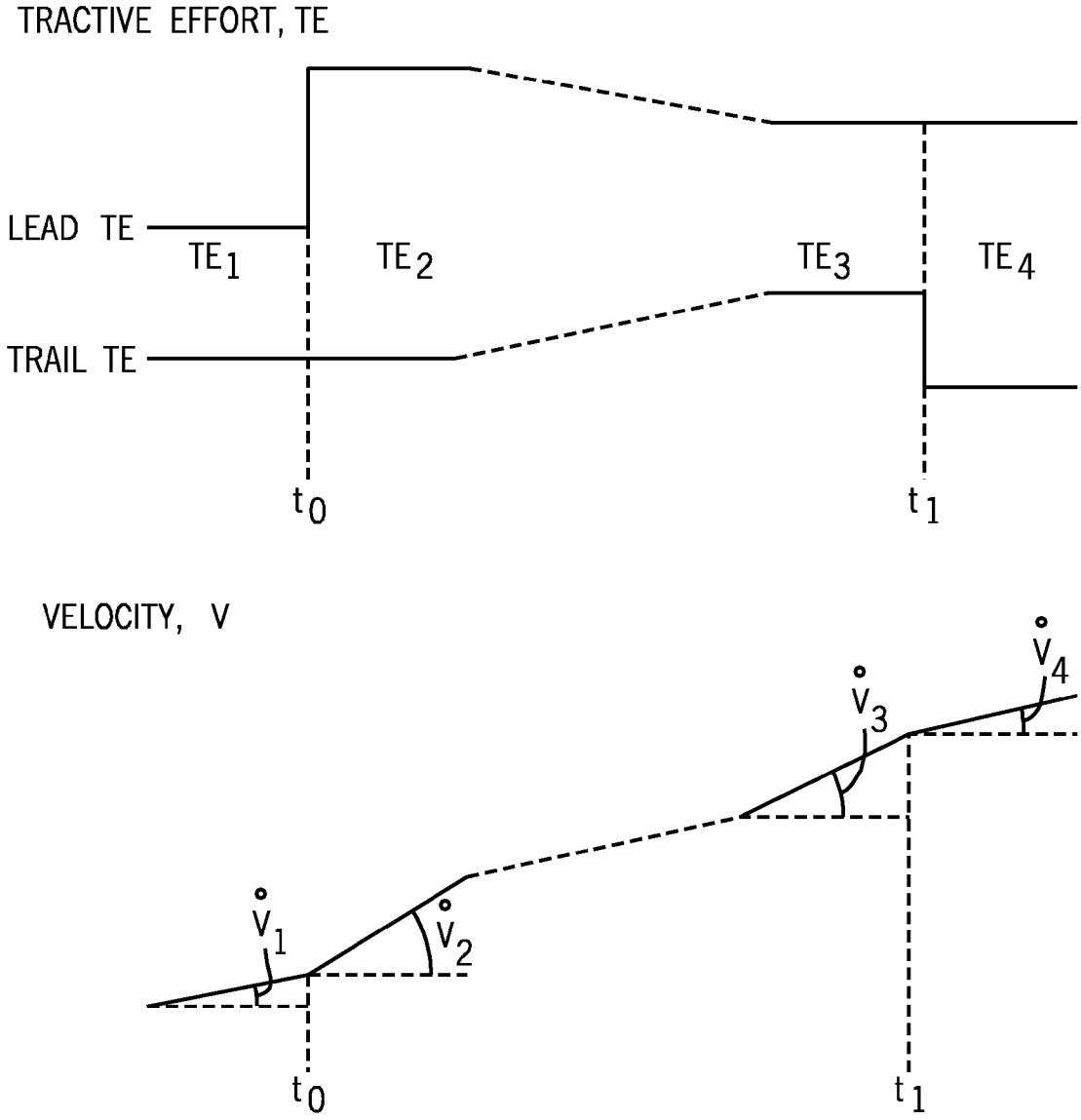
FIG. 6 is a graphical representation of changes in velocity and acceleration of a series of vehicles caused by a change in tractive effort of a trail locomotive unit of the series of vehicles in accordance with certain embodiments of the present technique.

Once it is determined that the train 10 is in an appropriate state, the process 52 may be started. In this instance, the tractive effort may be changed from $TE_3$ to $TE_4$ at a time $t_1$, as illustrated in FIG. 6. In the illustrated time series, $t_1$ is a point in time after $t_0$, as discussed above with respect to the process 44 of estimating the total weight of the series of vehicles. Therefore, in this illustration, it is assumed that the change in tractive effort from $TE_3$ to $TE_4$ at time $t_1$ occurs after a change in total tractive effort from $TE_1$ to $TE_2$ at time $t_0$ (from process 44). However, it need not necessarily be true that the increase from $TE_1$ to $TE_2$ at time to has already occurred. For instance, if the total weight of the series of vehicles is already known based on another estimation, the process 44 of estimating the total weight of the series of vehicles may be skipped and the process 52 of estimating a tractive effort may be performed independently.

As illustrated, after the change in tractive effort from $TE_1$ to $TE_2$ at time $t_0$, the values for the tractive effort of the lead locomotive $TE_{lead}$, the values for the cumulative tractive effort of the trail locomotives $TE_{trail}$, the velocity v of the series of vehicles, and the acceleration v of the series of vehicles may all have changed a marginal amount by time $t_1$. However, these slight variations are insignificant to the estimation techniques discussed herein.

The tractive effort of a trail locomotive may be changed at time $t_1$ while either holding the tractive effort of the lead locomotive constant or changing the tractive effort of the lead locomotive by a known amount, leading to a change in total tractive effort from $TE_3$ to $TE_4$. The exact value of tractive effort of the lead locomotive may be observed. However, the exact value for the trail locomotive being controlled may not be known. Indeed, this is one reason why process 52 may prove useful—to estimate unknown values of tractive effort for trail locomotives. As discussed above with respect to the process 44 of estimating the total weight of the series of vehicles, the transition from tractive effort $TE_3$ to tractive effort $TE_4$ may take 10 seconds or so. However, again, it may be assumed that the velocity v and grade g remain generally constant before and after $t_1$ and, therefore, the resulting change in acceleration ($\dot{v}_4-\dot{v}_3$) would be primarily due to the change in total tractive effort ($TE_4-TE_3$). Therefore, since the total mass of the train 10 is already known, the change in tractive effort of the trail locomotive being controlled may be calculated using the equation:

$$TE_4-TE_3=m(\dot{v}_4-\dot{v}_3)$$

Alternatively, assuming that this process 52 of estimating the change in tractive effort of the trail locomotive being controlled is performed after the process 44 of estimating the total weight of the series of vehicles, the change in tractive effort of the trail locomotive being controlled may be calculated using the equation:

$$TE_4 - TE_3 = (TE_2 - TE_1)\frac{(\dot{v}_4 - \dot{v}_3)}{(\dot{v}_2 - \dot{v}_1)}$$

This illustrates how the slight variations of $TE_{lead}$, $TE_{trail}$, v, and $\bar{v}$ from $t_0$ to $t_1$ are insignificant to the disclosed embodiments, because only the states before and after time $t_0$ and $t_1$ are used in the estimations. In addition, as will be appreciated by those skilled in the art, the tractive effort of the trail locomotive being controlled may be estimated by changing the tractive effort of the trail locomotive while at the same time changing the tractive effort of the lead locomotive by a known amount such that the acceleration of the train 10 remains generally constant. In doing so, the tractive effort added/subtracted by the trail locomotive may be offset by the known tractive effort added/subtracted by the lead locomotive, thereby making an estimation of the tractive effort of the trail locomotive possible.

Furthermore, the process 52 of estimating the change in tractive effort of the trail locomotive being controlled may be repeated for each notch level for each trail locomotive. For instance, the process 52 may be repeated from notch 8 to notch 7, notch 7 to notch 6, and so forth, for each trail locomotive until a complete tractive effort curve for each trail locomotive unit has been estimated. The process 52 may also be repeated for each consist of locomotives.

FIG. 7 illustrates an exemplary process 60 for automatically estimating the weight distribution of a series of vehicles based on a change in total tractive effort while holding the velocity of the series of vehicles constant over a known grade. First, the series of vehicles traverses a known grade while holding the velocity constant by changing the total tractive effort (step 62). For instance, the tractive effort of the lead locomotive may be increased while the series of vehicles traverses a known incline. An important issue is that the velocity of the series of vehicles remains generally constant. Next, the resulting change in the total tractive effort may be determined (step 64). This would, for instance, be possible if it is the lead locomotive being controlled. Then, the weight distribution of the series of vehicles may be calculated based on the resulting change in total tractive effort to hold the velocity of the series of vehicles constant over the known grade (step 66).

Once again, the process 60 of estimating the weight distribution of a series of vehicles will be described herein in the context of a train 10. However, the disclosed embodiments may be applicable to any other application where a series of interconnected vehicles are used. Also, the process 60 of estimating the weight distribution may once again begin by determining whether the rail cars and locomotives of the train 10 are completely, or significantly, stretched or bunched together or at a steady state.

Once it is determined that the train 10 is in an appropriate state, the process 60 may be started. When the train 10 transitions from a known grade $g_1$ to a different known grade $g_2$ for the entire length of the train 10, the weight distribution may be determined using the disclosed embodiments. In addition, the weight distribution may be determined even when the train 10 transitions from an unknown grade $g_1$ to another unknown grade $g_2$ as long as the grade change ($g_2-g_1$) is known. In the present embodiment, the velocity of the train 10 is regulated by changing only the tractive effort of a locomotive whose tractive effort is known (e.g., the lead locomotive). Other locomotives' tractive efforts may be held generally constant. When the first car has transitioned from $g_1$ to $g_2$, the extra tractive effort to hold the speed of the train 10 constant is due to the mass of the first car $m_1$ changing from $g_1$ to $g_2$, as illustrated in FIG. 8A. Since the velocity v and acceleration $\dot{v}$ are held constant, the equation used to estimate the mass of the first car is:

$$m_1 = \frac{TE_1 - TE_0}{g_2 - g_1}$$

This process may be repeated for every rail car and locomotive in the train 10 until the weight distribution of the entire train 10 has been estimated, as illustrated in FIG. 8B using the following series of equations:

$$m_1 = \frac{TE_1 - TE_0}{g_2 - g_1} \text{ for the first car,}$$

$$m_2 = \frac{TE_2 - TE_1}{g_2 - g_1} \text{ for the second car, and so forth}$$

$$m_{total} = m_1 + m_2 + \ldots$$

Furthermore, the weight distribution of the entire train 10 may be estimated by differentiating the total tractive effort curve. In other words, the slope of the total tractive effort curve may yield the weight distribution of the train 10. Furthermore, if the exact values of $g_1$ and $g_2$ are not known, then the grade change from $g_1$ to $g_2$ may be estimated if the weight of one of the rail cars or locomotives is known. For instance, if the weight of the first car (presumably the lead locomotive) is known, the following equation may be used to estimate the grade change:

$$g_2 - g_1 = \frac{TE_1 - TE_0}{m_1}$$

It should be noted that the weight distribution obtained by the disclosed embodiments may not be per rail car or locomotive but rather per length of the train 10. For instance, the first third of the train 10 may have a certain weight, the second third of the train 10 may have a certain weight, and the last third of the train 10 may have a certain weight. It is this type of weight distribution information which may be more useful from a practical standpoint for operation of the train 10. However, using the self-analysis/estimation system of the disclosed embodiments, it may be possible to estimate the weight distribution of the train 10 more precisely.

If $g_2$ is not available for the whole length of the train 10 (e.g., if the grade changes to $g_3$ before the whole train 10 traverses onto $g_2$), the disclosed embodiments may still be used with minor modifications. For instance, using the scenario illustrated in FIG. 8C, the change in total tractive effort when the first car traverses from $g_2$ to $g_3$ may be estimated using the equation:

$$TE_y - TE_x = m_1(g_3 - g_2) + m_4(g_2 - g_1)$$

where $m_1$ is a portion of the first car/locomotive (e.g., the lead locomotive) and $m_4$ is a portion of the fourth car/locomotive where $m_1$ is traversing onto $g_3$ while $m_4$ is traversing onto $g_2$. Since all other terms may be known, $m_4$ may be calculated as:

$$m_4 = \frac{(TE_y - TE_x) - m_1(g_3 - g_2)}{(g_2 - g_1)}$$

Of course, in the illustrated scenario of FIG. 8C, the train 10 has only four cars and locomotives and the fourth car/locomotive is traveling onto $g_2$ while the first car/locomotive is traveling onto $g_3$. However, the disclosed embodiments also work where $m_n$ is the $n^{th}$ rail car which is traveling onto $g_2$ while $m_1$ is traveling onto $g_3$. In addition, once the weight distribution of the train 10 is known, the disclosed embodiments may be used in reverse fashion to determine grade changes while holding the speed of the train 10 constant.

The technical effect of exemplary embodiments of the present invention is to provide for a system and method (e.g., computer-implemented method using computer software code) for automatically estimating parameters of a series of vehicles (e.g., the rail cars and locomotives of a train 10) and optimizing a trip plan for the series of vehicles based on the estimations, as discussed in detail above with reference to FIGS. 1-8. Thus, the embodiments described above may be implemented on a suitable computer system, controller, memory, or generally a machine readable medium. For example, each step, equation, and estimation technique may correspond to a computer instruction, logic, or software code disposed on the machine readable medium. The computer-implemented methods and/or computer code may be programmed into an electronic control unit (ECU) of an engine, a main control system of the locomotive unit, a remote control station that communicates with the locomotive unit, or the like.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A locomotive system, comprising:

a locomotive control system comprising instructions disposed on a computer readable medium, the instructions comprising:

instructions for estimating a total weight of a series of vehicles based on a change in a total tractive effort and a resulting change in an acceleration of the series of vehicles;

instructions for estimating a tractive effort based on a change in the tractive effort and a resulting change in an acceleration of the series of vehicles;

instructions for estimating a weight distribution of the series of vehicles based on a change in a tractive effort over a known grade; and instructions for optimizing parameters of a trip of the series of vehicles based on estimations of the total weight, the tractive effort, and the weight distribution.

2. The locomotive system of claim 1, wherein the instructions for estimating total weight comprise estimating total mass as a ratio of the change in the tractive effort over the resulting change in the acceleration of the series of vehicles, wherein a velocity of the series of vehicles and a grade of a route traversed by the series of vehicles are assumed constant.

3. The locomotive system of claim 2, wherein the change in tractive effort is based only on one or more known locomotive units while any unknown locomotive units are held at a constant tractive effort.

4. The locomotive system of claim 1, wherein the instructions for estimating the tractive effort are based on a known total weight of the series of vehicles, wherein a velocity of the series of vehicles and a grade of a route traversed by the series of vehicles are assumed constant.

5. The locomotive system of claim 1, wherein the instructions for estimating the weight distribution comprises estimating a mass of a portion of the series of vehicles as a ratio of the change in tractive effort over the change in grade, wherein the change in tractive effort results from holding velocity constant for the series of vehicles in response to the change in grade.

6. The locomotive system of claim 1, wherein the instructions for optimizing parameters of the trip comprises instructions for optimizing fuel consumption, exhaust emissions, time to destination, distribution of forces within the vehicles, handling of the vehicles, or a combination thereof.

7. The locomotive system of claim 1, comprising an engine, a locomotive having the engine, a train having the locomotive, or a combination thereof, coupled to the locomotive control system.

* * * * *